US007971455B2

(12) United States Patent
De Wree et al.

(10) Patent No.: US 7,971,455 B2
(45) Date of Patent: Jul. 5, 2011

(54) DOSING AND DISPENSING DEVICE

(75) Inventors: Ann De Wree, Outer (BE); Filip Dominique Hubert Vangeel, Vilvoorde (BE)

(73) Assignee: The Procter & Gamble Company, Cincinnati, OH (US)

( * ) Notice: Subject to any disclaimer, the term of this patent is extended or adjusted under 35 U.S.C. 154(b) by 377 days.

(21) Appl. No.: 12/145,821

(22) Filed: Jun. 25, 2008

(65) Prior Publication Data

US 2009/0014465 A1 Jan. 15, 2009

(30) Foreign Application Priority Data

Jul. 13, 2007 (EP) ..... 07112436

(51) Int. Cl.
*D06F 39/08* (2006.01)

(52) U.S. Cl. ..... 68/17 R; 68/213

(58) Field of Classification Search ..... 68/17 R, 68/207, 213

See application file for complete search history.

(56) References Cited

U.S. PATENT DOCUMENTS

| | | | | |
|---|---|---|---|---|
| 2,108,692 | A * | 2/1938 | Pieck | 141/381 |
| 3,581,927 | A * | 6/1971 | Langdon | 215/228 |
| 4,844,302 | A * | 7/1989 | Lay | 222/568 |
| 4,875,600 | A * | 10/1989 | D'Hoogue et al. | 222/52 |
| 4,893,726 | A * | 1/1990 | Vesborg | 220/495.01 |
| 5,165,558 | A * | 11/1992 | Cargile | 215/391 |
| 5,358,152 | A * | 10/1994 | Banks | 222/442 |
| 6,041,979 | A * | 3/2000 | Robbins et al. | 222/434 |
| 6,263,732 | B1 * | 7/2001 | Hoeting et al. | 73/427 |
| 2008/0178637 | A1 * | 7/2008 | Etesse et al. | 68/17 R |

FOREIGN PATENT DOCUMENTS

JP 09-142515 * 6/1997

(Continued)

OTHER PUBLICATIONS

European Patent Office Search Report dated Dec. 12, 2007, 5 pages.

*Primary Examiner* — Frankie L Stinson

(74) *Attorney, Agent, or Firm* — Marianne Dressman; Armina E. Matthew; Stephen T. Murphy

(57) ABSTRACT

The present invention relates to a dosing and dispensing device (1) comprising a double wall structure having an inner wall (10) and an outer wall (20), wherein the inner wall (10) defines a dosing chamber (12) with an opening (14) for filling and dispensing, and the outer wall (20) circumscribes the inner wall (10) at a line of intersection (30) so that an upper part of the dosing chamber lies on one side of the line of intersection (30), within the outer wall (20), and a lower part of the dosing chamber lies on the other side of the line of intersection (30), outside of the outer wall (20).

The present invention further relates to a method dosing and dispensing a laundry product, preferably a liquid or gel detergent product, into a washing machine, comprising the steps of:

a) providing the dosing and dispensing device (1);
b) transferring a measured dose of a laundry product into the filling opening (14) of the dosing chamber (12) to fill, or partly fill, the dosing chamber (12);
c) placing the dosing and dispensing device (1) containing the laundry product into the drum of an automatic laundry washing machine;
d) running a washing cycle of the automatic laundry washing machine so that the laundry product is dispensed into the drum through the dispensing opening (14) of the dosing and dispensing device (1);
e) recovering the empty dosing and dispensing device (1) for re-use after the end of the wash cycle.

9 Claims, 1 Drawing Sheet

FOREIGN PATENT DOCUMENTS

| | | | |
|---|---|---|---|
| JP | 2001-171704 | * | 6/2001 |
| JP | 2001-199465 | * | 7/2001 |
| JP | 2006-168751 | * | 6/2006 |
| WO | WO 89/07166 | * | 8/1989 |
| WO | WO 92/09736 A1 | | 6/1992 |
| WO | WO 93/21372 A1 | | 10/1993 |

* cited by examiner

DOSING AND DISPENSING DEVICE

TECHNICAL FIELD

The present invention relates to a dosing and dispensing device, especially for use in a laundry washing machine. The present invention also relates to a method for dosing and dispensing a laundry product into a washing machine.

BACKGROUND OF THE INVENTION

Dispensing devices which are useful for machine washing of clothes are described in, for example, FR-A-2 563 250, published on 25 Oct. 1985.

It is known that, in order to obtain a good degree of cleanliness whilst minimizing wastage it is important to dose the right amount of product. This is commonly achieved by embossed dosing lines marks on the dispensing device but nevertheless accurate dosing can be difficult especially when measuring small quantities of liquid, less than 50 ml, such as is the case for concentrated or "compact" liquid or gel laundry detergents. Moreover such small dosing devices are difficult to hold in the hand whilst dosing, and are difficult to find amongst the wash load after the end of the wash cycle. Furthermore accidental spillage of product during dosing can easily occur.

The aim of the present invention is to provide a dosing and dispensing device which overcomes these problems.

SUMMARY OF THE INVENTION

The present invention relates to a dosing and dispensing device comprising a double wall structure having an inner wall and an outer wall, wherein the inner wall defines a dosing chamber with an opening for filling and dispensing, and the outer wall circumscribes the inner wall at a line of intersection so that an upper part of the dosing chamber lies on one side of the line of intersections within the outer wall, and a lower part of the dosing chamber lies on the other side of the line of intersection, outside of the outer wall.

The present invention further relates to a method of dosing and dispensing a laundry product into a washing machine, comprising the steps of:

a) providing a dosing and dispensing device comprising a double wall structure having an inner wall and an outer wall, wherein the inner wall defines the dosing chamber with an opening for filling and dispensing, and the outer wall circumscribes the inner wall at a line of intersection so that an upper part of the dosing chamber lies on one side of the line of intersection within the outer wall, and a lower part of the dosing chamber lies on the other side of the line of intersection, outside of the outer wall;

b) transferring a measured dose of a laundry product into the filling opening of the dosing chamber to fill, or partly fill the dosing chamber;

c) placing the dosing and dispensing device containing the laundry product into the drum of an automatic laundry washing machine;

d) running a washing cycle of the automatic laundry washing machine so that the laundry product is dispensed into the drum through the dispensing opening of the dosing and dispensing device;

e) recovering the empty dosing and dispensing device for re-use after the end of the wash cycle.

DETAILED DESCRIPTION OF THE INVENTION

Figure 1:
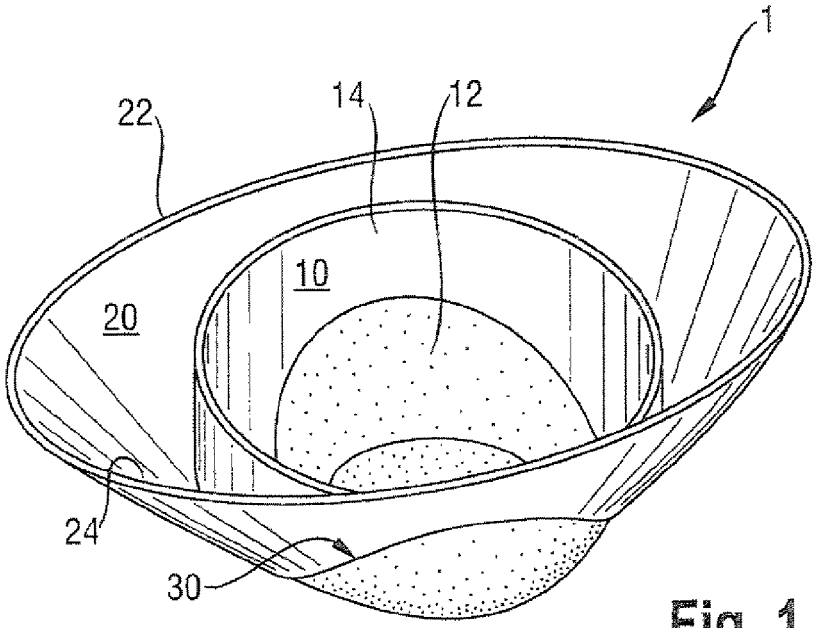
FIG. 1 illustrates a dosing and dispensing device according to the present invention.

The term "dosing and dispensing device", or "dosing device" for short, herein should be understood generally as a means for providing measured quantities of fluid products into a washing machine. By "fluid product" what is meant herein is any product which can flow under gravity. Fluid products may include granular or powdered products, but it is preferred herein that fluid products are liquid products or gels, more preferably liquid or gel detergent products. The present invention is particularly useful for dosing and dispensing of viscous liquid products or gels as defined in more detail below.

One of the advantages of the present invention is to reduce the incidence of accidental, messy spillages from the dosing device. This can be achieved by means of a spill chamber wherein the volume adjacent to the intersection line, between the outer wall and the dosing chamber, defines the spill chamber which retains any product overflow from the dosing chamber.

The volume of the dosing chamber can be advantageously designed to be equal to the recommended maximum dose of the fluid product. This means that the consumer fills the dosing chamber to the brim, promoting easy, accurate dosing. Even if a little fluid product might be spilt by filling the dosing chamber up to the brim, this spilt product would fall into the spill chamber without messiness. In this context, recommended maximum dose is the dose for highly soiled fabric loads and/or hard water. Smaller doses, e.g. 65% or 80% of the maximum recommended dose, may be recommended by the manufacturer for less soiled loads and/or softer water. Smaller recommended doses may be suitably indicated on the dosing chamber.

In a preferred embodiment of the invention at least a part of the lower part of the dosing chamber is flexible and resilient. This helps to reduce noise when the dosing and dispensing device is used in the rotating drum of a washing machine. In another preferred embodiment of the invention at least a part of the lower part of the dosing chamber is transparent or translucent. This helps with dosing accuracy.

Another advantage of the present invention is ease of handling of the dosing and dispensing device, especially during filling. Preferably the outer profile of the outer wall is ergonomically shaped for convenience and ease of handling. More preferably the free edge of the outer wall defines an elliptical or oval shape. The shape and profile of the outer wall make it easier to locate and recover the device after the wash cycle, and also help to prevent the device getting trapped within the washing machine, for example in a small gap adjacent to the window of a front loading washing machine.

The free edge of the outer wall may be adapted to releasably connect over a closure of a product container, or alternatively, with a region of the product container which is spaced apart from the product closure.

"Liquid detergent", as used herein, refers to any laundry treatment composition comprising a fluid capable of wetting and cleaning fabric e.g., clothing, in a domestic washing machine. The composition can include solids or gases in suitably subdivided form, for example suspended particles or bubbles. Compositions which are overall gases are excluded. The liquid detergent preferably have densities in the range from about 0.9 to about 1.3 grams, more preferably from about 1.00 to about 0.10 grains per cubic centimeter, excluding any suspended particles but including any bubbles, if present.

Preferably, the compositions and methods herein have a neat viscosity, $V_n$, of from about 1,000 cps (or equivalently, millipascal seconds, mPas) to about 10,000 cps as measured at 20 $s^{-1}$, more preferably from about 2,000 cps to about 5,000 cps as measured at 20 $s^{-1}$ and a diluted viscosity, $V_d$, that is less than or equal to about $0.5V_n$, as measured at 20 $s^{-1}$, preferably less than about $0.3V_n$, as measured at 20 $s^{-1}$. As used herein, "neat viscosity, $V_n$" refers to the viscosity of the undiluted liquid detergent. As used herein, "diluted viscosity, $V_d$" refers to the viscosity of a 50% by weight aqueous solution of a liquid detergent composition used in the methods of the present invention. In another more specific embodiment, when the liquid detergent composition is shear thinning, the composition may be characterized by a low-shear neat viscosity $V_{ls}$ of from about 10,000 cps to about 500,000 cps as measured at 0.5 $s^{-1}$ more preferably from about 10,000 cps to about 100,000 cps as measured at 0.5 $s^{-1}$. The water used to prepare the aqueous solution for determining the diluted viscosity, $V_d$ of a composition is deionized water. All viscosity measurements are made at 21° C.

The dilution procedure and the viscosity measurements are described hereinafter.

The viscosity of fluid detergents herein, namely $V_n$, and $V_d$, is measured using a TA AR550 Rheometer, manufactured by TA Instruments Ltd., Bilton Center, Cleeve Road, Letherhead, Surrey; KT22 7UQ, United Kingdom. The software used is provided with the instrument and called "Rheology Advantage Instrument Control AR".

The instrument is set up before each measurement according to the instructions reported in the Manual "AR550 Rheometer Instrument and accessory manual" (January 2004, PN500034.001 rev F) pp. 25-29, 40-44, and the Manual "Rheology advantage Instrument Control Getting Started Guide" (January 2004, Revision E) pp. 9-14, 20, 25-28, 37-38. The settlings and parameters used are described herein.

In the "Geometry" section of the software (see Rheology advantage Instrument Control Getting Started Guide" (January 2004, Revision E) p9), the gap between the rotating plate (40 mm steel plate) and the sample platform (Peltier plate) is set at 500 microns. The procedure is a continuous ramp test, i.e. a procedure in which the rheology of the sample is measured versus increasing shear rate. The setting for the shear rate ranges from 0.04 $s^{-1}$ to 30 $s^{-1}$ with a total duration of 3 minutes for the continuous ramp test, and sampling of 20 points per each tenfold increase in shear rate (automatically done), providing in total 60 measurements. Temperature is set at 21° C.

A sample of liquid detergent loaded into the rheometer using a loading procedure as described herein. The sample loading procedure (as described in detail in the manual) is as follows:

1. The temperature is checked (see "instrument status" section) to see if it matches the set temperature. If the temperature is not correct, the settings need to be verified following the instructions in the manual.
2. The sample is loaded using a plastic pipette with a minimum diameter of 4 mm at the tip (to minimize the impact of the stress carried out by the loading action on the rheology of the sample). A minimum amount of 5 ml needs to be applied in the center of the peltier plate to assure full product coverage of the rotating plate.
3. The rotating plate (plate connected to the measuring system) is brought to the set distance (as defined above).
4. The excess of sample (i.e. any sample that may be around the edges of the rotating plate) is removed with a spatula assuring correct loading of the sample according to the description in the manual.

The measurement steps are as follows:

5. After the sample is loaded it needs to be left for 10 seconds at rest. The run is started, while making sure the equipment is not exposed to vibrations during the measurement, as this will affect the results. In the case that the measurement is influenced by vibrations, the experiment is repeated whilst excluding the source of vibration.
6. At the end of the run the program stops automatically. All viscosity data are automatically saved.
7. The plates are cleaned with water and ethanol and then dried with paper towel.

The viscosity data, $V_n$, quoted herein is determined at a shear rate of 20 $s^{-1}$. In case no measurement was taken at exactly 20 $s^{-1}$, the data are calculated based on interpolation of the data points which are closest to the 20 $s^{-1}$ point.

In case the lower part of the dosing chamber is flexible and resilient, this improves the dispensing of liquid products which are viscous at low shear rates, such as those liquid detergents described above. The flexible part of the dosing chamber acts in the washing machine cycle to pump out the liquid product. A further advantage is reduction of noise when the dosing and dispensing device moves around inside the rotating drum of the washing machines.

Preferably the outer wall is injection moulded in a polyolefin, most preferably in polypropylene. The flexible part of the dosing chamber is preferably injection moulded in a soft material which should be compatible both physically and chemically with the material forming the outer wall. The soft material is typically a thermoplastic elastomer (TPE) or a thermoplastic elastomer-vulcanized (TPV) e.g. Engage®, Santoprene®, Dynaflex®. At the line of intersection where the outer wall circumscribes the dosing chamber, the two materials can be welded together. A preferred method of manufacture is by bi-injection, but other techniques such as ultra sound welding are also possible.

The method of the present invention is directed towards dosing and dispensing a laundry product, preferably a liquid or gel detergent product, into a washing machine. The method comprises the steps of:

a) providing a dosing and dispensing, device according to the present invention;
b) transferring a measured dose of a laundry product into the filling opening of the dosing chamber to fill or partly fill, the dosing chamber;
c) placing, the dosing and dispensing device containing the laundry product into the drum of an automatic laundry washing machine;
d) running a washing cycle of the automatic laundry washing machine so that the laundry product is dispensed into the drum through the dispensing opening of the dosing and dispensing device;
e) recovering the empty dosing and dispensing device for re-use after the end of the wash cycle.

In step b) the dose can be transferred into the dosing chamber preferably by pouring from a container or bottle, or by squeezing a container or bottle in cases where the product is a viscous liquid or gel.

The invention will be further described below with reference to the drawings.

Figure 2A:
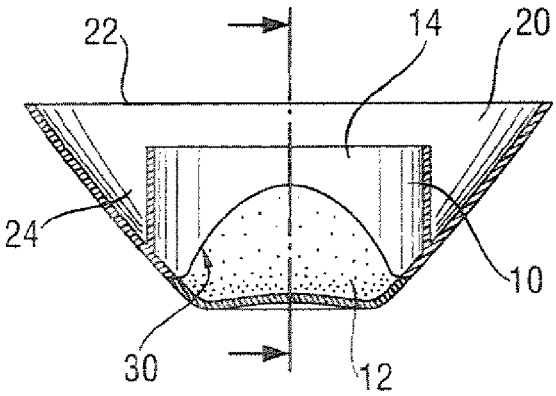
FIG. 2*a* shows a cross-section through the major axis of the dosing and dispensing device illustrated in FIG. 1.
Figure 2B:
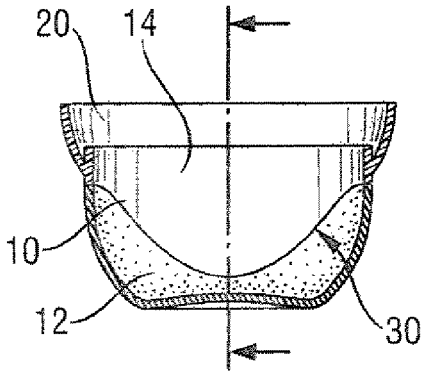
FIG. 2*b* shows a cross-section through the minor axis of the dosing and dispensing device illustrated in FIG. 1.

FIGS. 1 and 2 show a dosing and dispensing device 1 comprising a double wall structure having an inner wall 10 and an outer wall 20. The inner wall 10 defines a dosing chamber 12 with an opening 14 for filling and dispensing. The dosing and dispensing device further comprises an outer wall 20 which circumscribes the inner wall 10 at a line of intersection 30. The free edge 22 of the outer wall is elliptical.

The line of intersection 20 divides the dosing chamber 12 into a dosing chamber upper part and a dosing chamber lower part. The upper part of the dosing chamber lies within the outer wall 20 and the volume between the dosing chamber and the outer wall defines a spill chamber 24. In the illustrated example, the lower part of the dosing chamber is flexible, resilient and also translucent.

One example of a releaseable connection between the outer wall of the dosing device and the product container or product container closure, is by means of so called "snap beads". The position and geometry of the snap beads should be designed to obtain the right removal force which is from about 30 N to about 100 N in the direction of the axis of the dosing device.

The dimensions and values disclosed herein are not to be understood as being strictly limited to the exact numerical values recited. Instead, unless otherwise specified, each such dimension is intended to mean both the recited value and a functionally equivalent range surrounding that value. For example a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dosing and dispensing device (1) comprising a double wall structure having an inner wall (10) and an outer wall (20), wherein the inner wall (10) defines a dosing chamber (12) with an opening (14) for filling and dispensing, and an outer wall (20) having a free edge (22) having an elliptical or oval shape, wherein the outer wall (20) circumscribes the inner wall (10) at a line of intersection (30) so that an upper part of the dosing chamber lies on one side of the line of intersection (30), within the outer wall (20), and a lower part of the dosing chamber lies on the other side of the line of intersection (30), outside of the outer wall (20), and wherein the volume between the outer wall (20) and the upper part of the dosing chamber (12), defines a spill chamber (24) which retains any product overflow from the dosing chamber (12).

2. A dosing and dispensing device (1) according to claim 1 wherein at least part of the lower part of the dosing chamber is flexible and resilient.

3. A dosing and dispensing device (1) according to claim 1 wherein at least part of the lower part of the dosing chamber is transparent or translucent.

4. A dosing and dispensing device (1) according to claim 1 wherein the outer profile of the outer wall (20) is ergonomically shaped for convenience and ease of handling.

5. A dosing and dispensing device (1) according to claim 1 wherein the free edge (22) of the outer wall (24) is adapted to releasably connect with a product container.

6. A dosing and dispensing device (1) according to claim 5 wherein the free edge (22) of the outer wall (24) is adapted to releasably connect at a region of the product container which is spaced apart from the product closure.

7. A dosing and dispensing device (1) according to claim 5 wherein the free edge (22) of the outer wall (24) is adapted to releasably connect over the closure of the product container.

8. A method of dosing and dispensing a laundry product into a washing machine, comprising the steps of:

a) providing a dosing and dispensing device according to claim 1;

b) transferring a measured dose of a laundry product into the filling opening (14) of the dosing chamber (12) to fill, or partly fill, the dosing chamber (12);

c) placing the dosing and dispensing device (1) containing the laundry product into the drum of an automatic laundry washing machine;

d) running a washing cycle of the automatic laundry washing machine so that the laundry product is dispensed into the drum through the dispensing opening (14) of the dosing and dispensing device (1);

e) recovering the empty dosing and dispensing device (1) for re-use after the end of the wash cycle.

9. A method according to claim 8 wherein the laundry product is a liquid or gel detergent product.

* * * * *